US007269943B2

(12) United States Patent
Buckmier et al.

(10) Patent No.: US 7,269,943 B2
(45) Date of Patent: Sep. 18, 2007

(54) APPARATUS AND METHOD FOR CONTROLLING WORK TOOL VIBRATION

(75) Inventors: Jason M Buckmier, Cary, NC (US); Daniel A Cockman, Cary, NC (US); Luke E Graham, Normal, IL (US); Gilles Hoessler, Moretel de Mailles (FR); David L Messer, Morton, IL (US); W Ryan Most, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 194 days.

(21) Appl. No.: 11/123,315

(22) Filed: May 6, 2005

(65) Prior Publication Data

US 2006/0248885 A1 Nov. 9, 2006

(51) Int. Cl.
*F16D 31/00* (2006.01)

(52) U.S. Cl. ..... 60/368; 60/327

(58) Field of Classification Search ..... 60/327, 60/368

See application file for complete search history.

(56) References Cited

U.S. PATENT DOCUMENTS 5,287,699 A * 2/1994 Takamura et al. ..... 60/327
5,860,231 A 1/1999 Lee et al.
6,725,105 B2 4/2004 Francis et al.
6,763,661 B2 7/2004 Tabor et al.

* cited by examiner

*Primary Examiner*—Michael Leslie
(74) *Attorney, Agent, or Firm*—D. James Barnes; Finnegan, Henderson, Farabow, Garrett & Dunner

(57) ABSTRACT

An apparatus and method for controlling a work tool on a work machine are provided. The work machine may have first and second actuators, each actuator being operable in a vibratory mode and a non-vibratory mode, and each actuator being coupled to the work tool for changing the position of the work tool. The method may include simultaneously (i) operating the first actuator in a vibratory mode, (ii) operating the second actuator in a vibratory mode, and (iii) receiving a command to change the position of the work tool. The method may further include operating the first actuator in a non-vibratory mode to change the position of the work tool while operating the second actuator in a vibratory mode to vibrate the work tool, in response to receiving the command.

18 Claims, 3 Drawing Sheets

APPARATUS AND METHOD FOR CONTROLLING WORK TOOL VIBRATION

TECHNICAL FIELD

This invention relates generally to a method and apparatus for controlling a work tool and, more particularly, to a method and apparatus for controlling vibratory motion of a work tool.

BACKGROUND

During operation of work machines, it is sometimes desirable to move a work tool in a vibratory manner to accomplish some purpose. For example, an operator of an earth working machine having a work tool such as a bucket may desire to cause the bucket to move in a vibratory manner to (i) shake material out of the bucket that does not readily fall out, (ii) cause the bucket to penetrate hard material such as clay or rock, (iii) compact a surface, or (iv) perform some other function.

In the past, the standard method for vibrating a work tool has been for an operator to rapidly move the work tool control, such as a joystick or lever, back and forth until the task was completed. This method involves rapid motion by the operator that, over time, can become tedious and tiring. This technique is also only limited to certain work functions, such as shaking material out of the tool. Other functions, such as vibratory compaction of a surface, may not be efficiently performed by manual operation.

With the advent of electro-hydraulics, it has become possible to automate control of work tools in many ways that required manual control in the past. For example, computer-based controllers can be programmed to operate electro-hydraulic valves and solenoids with great precision, thus alleviating many of the difficult, tedious, tiring, or time-consuming tasks that operators previously had to perform.

In U.S. Pat. No. 5,860,231, Lee et al. discloses a system that automates the vibratory motion of a work tool by operator selection of a vibratory mode. The automatic method allows for work tool vibratory applications for several purposes, such as excavating, ground breaking, ground hardening (compaction), and the like.

Prior art devices and methods for controlling the vibratory motion of a work tool may still be improved by providing more sophisticated or more effective vibratory control mechanisms. For example, devices and methods may be desirable that effectively coordinate vibratory and non-vibratory operations among multiple work tool actuators.

The present invention is directed at overcoming one or more disadvantages associated with prior devices and methods for controlling vibratory operation of a work tool.

SUMMARY OF THE INVENTION

In one aspect of the present invention, a method for controlling a work tool on a work machine is provided, the work machine having first and second actuators, each actuator being operable in a vibratory mode and a non-vibratory mode, and each actuator being coupled to the work tool for changing the position of the work tool. The method may include simultaneously (i) operating the first actuator in a vibratory mode, (ii) operating the second actuator in a vibratory mode, and (iii) receiving a command to change the position of the work tool. The method may further include operating the first actuator in a non-vibratory mode to change the position of the work tool while operating the second actuator in a vibratory mode to vibrate the work tool, in response to receiving the command.

In another aspect of the present invention, a work machine is provided. The work machine may include a work tool, first and second actuators, a vibration control device, a work tool control device, and a controller. The first actuator may be operably coupled to the work tool for changing the position of the work tool and may be operable in a vibratory mode and in a non-vibratory mode. The second actuator also may be operably coupled to the work tool for changing the position of the work tool and may be operable in a vibratory mode and in a non-vibratory mode. The vibration control device may be operable to generate a vibration operation signal, and the work tool control device may be operable to generate a command signal to change the position of the work tool. The controller may be electrically coupled with the vibration control device, the work tool control device, and the first and second actuators. Further, the controller may be operable to, in response to receiving the vibration operation signal and the command signal, output a signal to operate the first actuator in a non-vibratory mode to change the position of the work tool while outputting a signal to operate the second actuator in a vibratory mode to cause vibration of the work tool.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments or features of the invention and, together with the description, serve to explain the principles of the invention. In the drawings.

Although the drawings depict exemplary embodiments or features of the present invention, the drawings are not necessarily to scale, and certain features may be exaggerated in order to better illustrate and explain the present invention. The exemplifications set out herein illustrate exemplary embodiments or features of the invention and such exemplifications are not to be construed as limiting the scope of the invention in any manner.

DETAILED DESCRIPTION

Reference will now be made in detail to embodiments or features of the invention, examples of which are illustrated in the accompanying drawings. Wherever possible, the same or corresponding reference numbers will be used throughout the drawings to refer to the same or corresponding parts.

Figure 1:
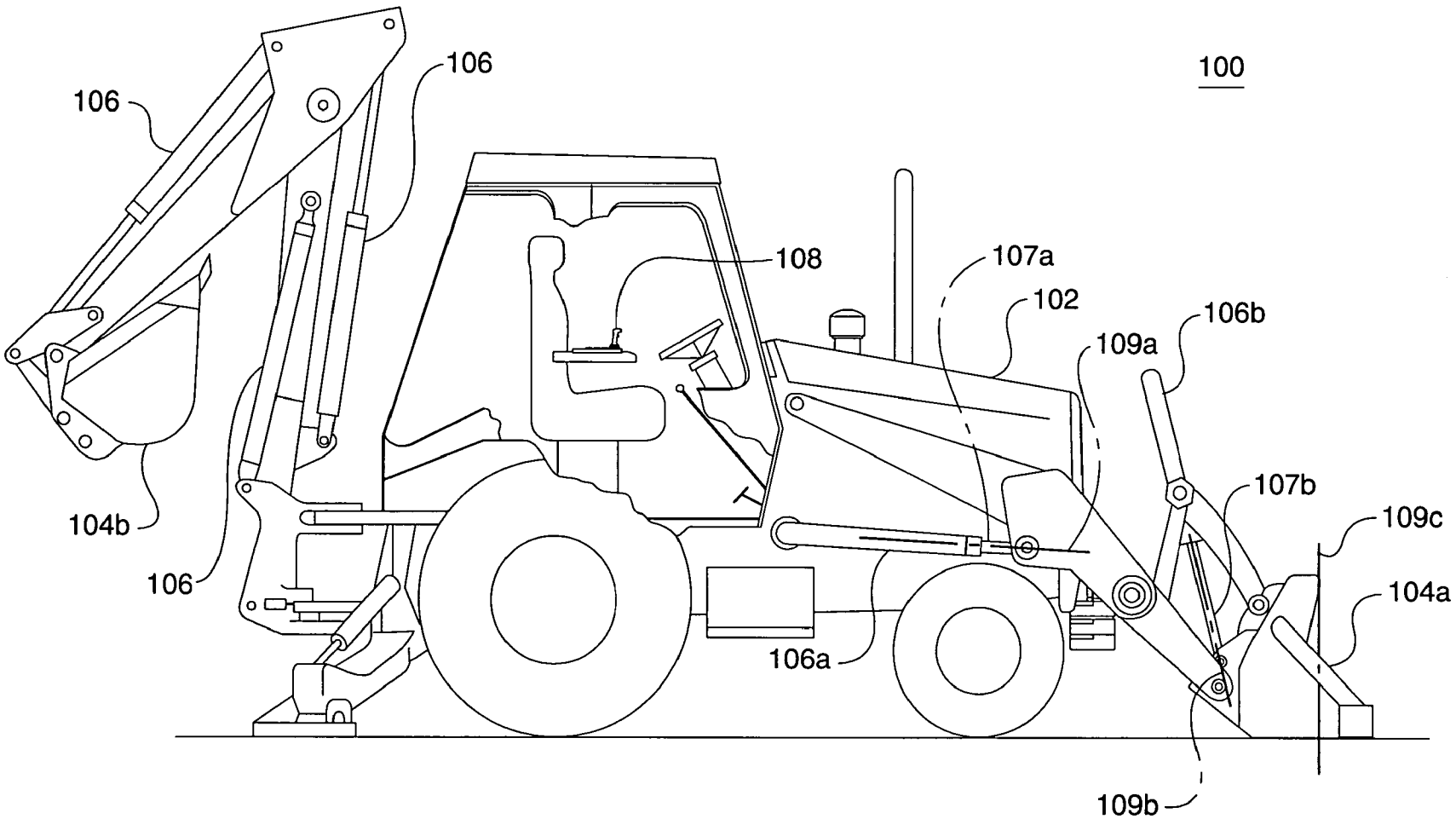
FIG. 1 is a diagrammatic illustration of a work machine suited for use with the present invention.

With reference to FIG. 1, an example of a work machine 102 suited for use with the present invention is shown. The work machine 102 is shown as an earth working maching, and in particular, a backhoe loader. However, other types of earth working machines may apply, such as excavators, wheel loaders, skid steer loaders, front shovels, and track loaders to name a few. Furthermore, the work machine 102 may be of a type other than an earth working machine. For example, the work machine 102 may be a machine used for construction, material transfer, manufacturing, agriculture, and such, provided that the present invention may find application with the machine.

A work tool 104, mounted on the work machine 102, performs a work function of some type. The work tools 104*a*, 104*b* shown in FIG. 1 are depicted as buckets. More specifically, a work tool 104*a* embodied as a loader bucket is shown at the front of the work machine 102, and another work tool 104*b* embodied as a backhoe bucket is shown at the rear of the work machine 102. It is noted that, although both illustrated work tools are shown as buckets, other types of work tools may apply. Examples of other work tools include, but are not limited to, augers, blades, cutting tools, trenchers, and the like.

Without intending to be limiting in scope and application, the present invention is hereinbelow described with exemplary reference to a work machine 102 being a backhoe loader having a work tool 104*a* that is a bucket for digging or otherwise moving material.

The work machine 102 exemplified herein may include one or more actuators 106, for example hydraulic cylinders 106*a*, 106*b*, operably coupled to the work tool 104 for changing the position of the work tool 104*a*. The work machine 102 of FIG. 1 includes a first hydraulic cylinder 106*a*, for example to control elevation of the work tool 104*a*, and a second hydraulic cylinder 106*b* for control of the tilt angle of the work tool 104*a*. As will be explained further below, each hydraulic cylinder 106*a*, 106*b* may be operable in a vibratory mode and in a non-vibratory mode. Moreover, each hydraulic cylinder 106*a*, 106*b* may include an actuation member 107*a*, 107*b* operable to move along an axis 109*a*, 109*b* to change the position of the work tool 104*a*. For example, actuation member 107*a* of hydraulic cylinder 106*a* is operable to move along axis 109*a* to control elevation of the work tool 104*a*. Further, actuation member 107*b* of hydraulic cylinder 106*b* is operable to move along axis 109*b* to control the tilt angle of the work tool 104*a*. It should be appreciated that hydraulic cylinders 106*a*, 106*b* may be arranged such that the first and second axes 109*a*, 109*b* are not parallel to each other, thus providing for dual- or multi-axis control of the work tool 104*a*. It should further be appreciated that the hydraulic cylinders 106*a*, 106*b* may be arranged such that operation of one of the hydraulic cylinders 106*a* causes the work tool to move along a desired axis 109*c* for translational-type movement of the work tool 104*a*. Moreover, as may be appreciated by an examination of FIG. 1, the hydraulic cylinders may be arranged such that operation of a different hydraulic cylinder 106*b* causes the work tool to rotate about a desired axis, for example an axis extending outward from FIG. 1 (i.e., perpendicular to axis 109*c* and perpendicular to sheet 1). Thus, selective operation of hydraulic cylinders 106*a* and 106*b* may cause dual axis movement of the work tool 104*a*. Additional hydraulic cylinders 106 may also be used. For example, the hydraulic cylinders 106*a*, 106*b* in FIG. 1 may be replicated on the side of the work machine 102 not shown.

It is noted that the backhoe loader example is typically a hydraulically actuated machine. Other machines suited for use with the present invention may not necessarily include hydraulic actuation, and may instead rely on other types of actuation, such as electrical or mechanical actuation, for example.

Figure 2:
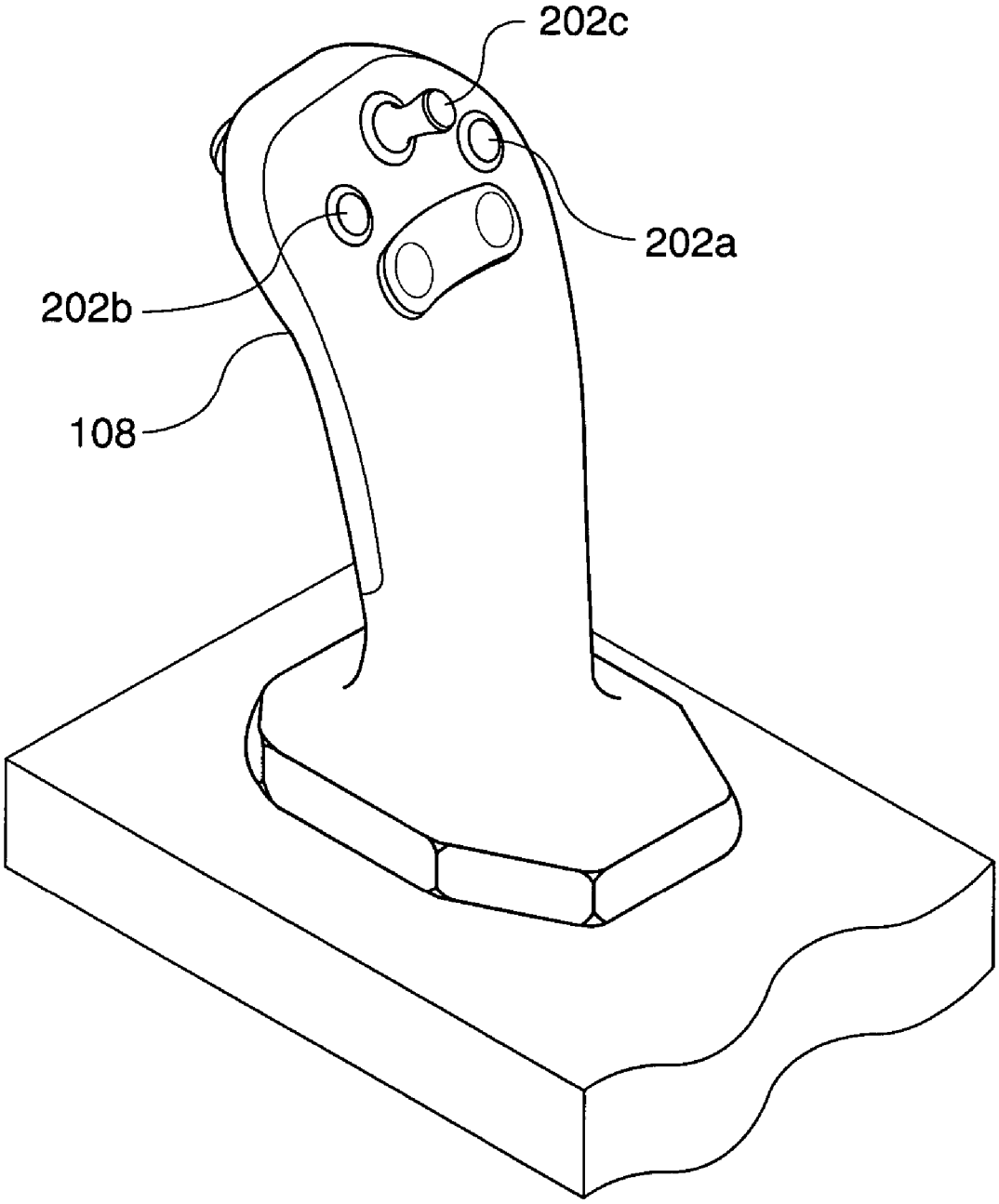
FIG. 2 is a diagrammatic illustration of a joystick as may be located on the work machine of FIG. 1.

With reference to FIGS. 1 and 2, an input assembly embodied as a joystick 108 is shown. The joystick 108 may be used to control the work tool 104*a* and may be operable to generate command signals to move the work tool 104*a*. Although joysticks are commonly used to control work tools on work machines, other types of work tool control devices may be used, such as levers, switches, buttons, pedals, and the like. The joystick 108 of FIG. 2 may include buttons 202 for actuation of a function. For example, buttons 202*a*, 202*b*, 202*c* may be used as vibration control devices and may be operable to generate vibration operation signals, as described in greater detail below.

Figure 3:
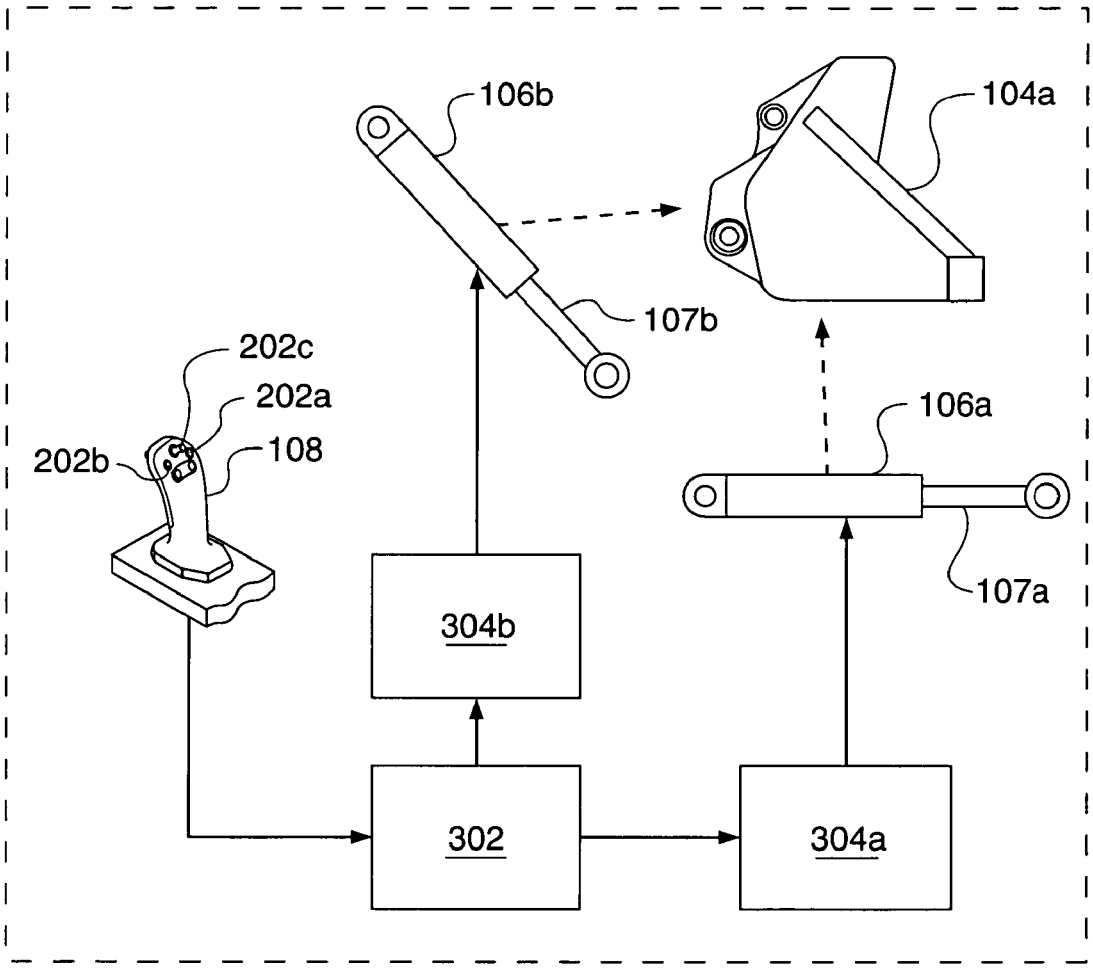
FIG. 3 is a block diagram depicting an embodiment of the present invention.

Referring to FIG. 3, a block diagram illustrating an embodiment of the present invention is shown. A controller 302 may be electrically coupled with, and configured to receive command inputs from, an input assembly such as the joystick 108 or a button 202*a*, 202*b*, 202*c*. The controller 302 may also be electrically coupled to the actuators 106*a*, 106*b*, for example through one or more electro-hydraulic valve assemblies 304. The controller 302 may send output commands to the electro-hydraulic valves 304*a*, 304*b*, which in turn actuate the hydraulic cylinders 106*a*, 106*b*, which control the position and movement of the work tool 104*a*. The controller 302 may be microprocessor-based, i.e., computer-based, and may be dedicated for use with the present invention or may be used for other purposes as well. For example, the controller 302 may be an electronic control module (ECM) that performs a number of machine functions and may include software to specifically perform work associated with the present invention.

It should be appreciated that the controller 302, in order to produce operation of the hydraulic cylinders 106*a*, 106*b* in a vibratory mode, may be configured to generate commands of desired amplitude and frequency and to deliver such commands to the electro-hydraulic valves 304 to cause desired operation of the work tool 104*a* in a vibratory, i.e., back and forth, manner. The desired amplitude and frequency may be determined as a function of one or more factors, such as the type of work tool 104*a*, the type of work machine 102, characteristics of the material being worked by the work tool, the type of work being performed, and the like.

INDUSTRIAL APPLICABILITY

An example of application of the present invention may be described with further reference to the block diagram of FIG. 3.

The joystick 108 may be configured to deliver commands to the controller 302 to extend or retract the hydraulic cylinder 106*a*, for example when the joystick 108 is moved left or right. The joystick 108 may also be configured to deliver commands to the controller 302 to extend or retract the hydraulic cylinder 106*b*, for example when the joystick 108 is moved up or down. Thus, movement of the joystick 108 may cause—for example through the controller 302, the electro-hydraulic valves 304, and extension or retraction of the hydraulic cylinders 106*a*, 106*b*—a change in position of the work tool 104*a*.

Each button 202*a*, 202*b* may be configured to deliver a vibration operation signal to the controller 302 to indicate desired operation of each hydraulic cylinder 106*a*, 106*b*, respectively, in a vibratory mode. Moreover, a single button 202*c* may be configured to deliver a vibration operation signal to the controller 302 to indicate desired operation of both hydraulic cylinders 106*a*, 106*b* simultaneously. For example, in one scenario the work tool 104*a* may be filled with dirt and held stationary over a dirt pile. An operator may selectively activate one or more of the buttons 202 to operate one or both hydraulic cylinders 106*a*, 106*b* in a vibratory mode individually, sequentially, and/or simultaneously to facilitate removal of the dirt from the work tool

104*a*. It should be appreciated that termination of a vibration operation signal may be determined as an operator releases the respective button 202 which delivered the initial vibration operation signal. Alternatively, a vibration operation signal may be initiated and continued for a predetermined period of time (e.g., 30 seconds) upon activation of a respective button 202.

The controller 302 may further be configured to control and coordinate vibratory and non-vibratory operation of multiple hydraulic cylinders 106*a*, 106*b*, for example during movement of the work tool 104*a*. For example, the controller 302 may be configured to selectively prevent, at least temporarily, operation of one or both hydraulic cylinders 106*a*, 106*b* in a vibratory mode as a function of receiving one or more commands to change the position of the work tool 104*a*. In one exemplary arrangement, the controller is operable to cancel, nullify, or otherwise override a vibration operation signal relative a specific hydraulic cylinder 106*a*, 106*b* in response to receipt of a command to change the position of the work tool 104*a* via operation of the specific hydraulic cylinder 106*a*, 106*b*.

In an exemplary scenario, an operator may activate appropriate button(s) 102 to simultaneously operate the first and second hydraulic cylinders 106*a*, 106*b* in a vibratory mode. Upon receipt of a command from the joystick 108 to change the position of the work tool 104*a* via operation of a the first hydraulic cylinder 106*a*, the controller 302 may prevent operation of the first hydraulic cylinder 106*a* in a vibratory mode, for example even if a vibration operation signal relative the first hydraulic cylinder 106*a* is still being received by the controller 302. Thus, the controller 302 may cause operation of the first hydraulic cylinder 106*a* in a non-vibratory mode to change the position of the work tool 104*a* while operating the second hydraulic cylinder 106*b* in a vibratory mode to vibrate the work tool.

Alternatively or subsequently, upon receipt of a command from the joystick 108 to change the position of the work tool 104*a* via operation of the second hydraulic cylinder 106*b*, the controller 302 may prevent operation of the second hydraulic cylinder 106*b* in a vibratory mode, for example even if a vibration operation signal relative the second hydraulic cylinder 106*b* is still being received by the controller 302. Thus, the controller 302 may cause operation of the second hydraulic cylinder 106*b* in a non-vibratory mode to change the position of the work tool 104*a* while operating the first hydraulic cylinder 106*a* in a vibratory mode to vibrate the work tool.

Alternatively or subsequently, upon receipt of a command from the joystick 108 to change the position of the work tool 104*a* via operation of both the first and second hydraulic cylinders 106*a*, 106*b*, the controller 302 may prevent operation of the first and second hydraulic cylinders 106*a*, 106*b* in a vibratory mode, for example even if vibration operation signal(s) relative the first and second hydraulic cylinders 106*a*, 106*b* are still being received by the controller 302. Thus, the controller 302 may cause operation of the first and second hydraulic cylinders 106*a*, 106*b* in a non-vibratory mode to change the position of the work tool 104*a*.

As detailed hereinabove, the present disclosure provides an effective apparatus and method to desirably coordinate vibratory and non-vibratory work tool operations among multiple work tool actuators.

From the foregoing it will be appreciated that, although specific embodiments of the invention have been described herein for purposes of illustration, various modifications may be made without deviating from the spirit or scope of the invention. Other embodiments of the invention will be apparent to those skilled in the art from consideration of the specification and figures and practice of the invention disclosed herein. It is intended that the specification and disclosed examples be considered as exemplary only, with a true scope and spirit of the invention being indicated by the following claims and their equivalents. Accordingly, the invention is not limited except as by the appended claims.

What is claimed is:

1. A method for controlling a work tool on a machine having first and second actuators, each actuator being operable in a vibratory mode and a non-vibratory mode, and each actuator being coupled to the work tool for changing the position of the work tool, comprising:

simultaneously (i) operating the first actuator in a vibratory mode, (ii) operating the second actuator in a vibratory mode, and (iii) receiving a command to change the position of the work tool;

operating the first actuator in a non-vibratory mode to change the position of the work tool while operating the second actuator in a vibratory mode to vibrate the work tool, in response to receiving the command.

2. The method of claim 1, including:

receiving a second command to change the position of the work tool;

ceasing operation of the second actuator in a vibratory mode and operating the second actuator in a non-vibratory mode to change the position of the work tool, in response to receiving the second command.

3. The method of claim 1, wherein the step of operating the first actuator in a vibratory mode includes causing an actuation member of the first actuator to alternate between extension and retraction motions along a first axis.

4. The method of claim 3, wherein the step of operating the first actuator in a non-vibratory mode includes causing the actuation member of the first actuator to move in one of an extension and a retraction motion along the first axis to change the position of work tool.

5. The method of claim 3, wherein the step of operating the second actuator in a vibratory mode includes causing an actuation member of the second actuator to alternate between extension and retraction motions along a second axis.

6. The method of claim 5, wherein the first and second axes are not parallel to each other.

7. The method of claim 1, including:

operating one of the first and second actuators to cause the work tool to at least one of move along a first axis and rotate about the first axis; and operating the other of the first and second actuators to cause the work tool to at least one of move along a second axis and rotate about the second axis.

8. The method of claim 7, wherein:

the step of operating one of the first and second actuators to cause the work tool to at least one of move along a first axis and rotate about the first axis includes changing the elevation of the work tool; and the step of operating the other of the first and second actuators to cause the work tool to at least one of move along a second axis and rotate about the second axis includes changing the tilt angle of the work tool.

9. A method for controlling a work tool on a machine having first and second actuators operably coupled to the work tool, each actuator being capable of operating in a vibratory mode and a non-vibratory mode for moving the work tool, comprising:

receiving a command to change the position of the work tool;

receiving a vibration operation signal; and performing the following steps in response to receiving the command and the vibration operation signal: (i) preventing, at least temporarily, the first actuator from being operated in a vibratory mode and (ii) operating the first actuator in a non-vibratory mode to change the position of the work tool while operating the second actuator in a vibratory mode to cause vibration of the work tool.

10. The method of claim 9, including:

receiving a second command to move the work tool; and performing the following steps in response to receiving the second command: (i) preventing, at least temporarily, the second actuator from being operated in a vibratory mode, (ii) operating the second actuator in a non-vibratory mode to change the position of the work tool while operating the first actuator in a vibratory mode to cause vibration of the work tool.

11. A machine, comprising:

a work tool;

a first actuator operably coupled to the work tool for changing the position of the work tool and being operable in a vibratory mode and in a non-vibratory mode;

a second actuator operably coupled to the work tool for changing the position of the work tool and being operable in a vibratory mode and in a non-vibratory mode;

a vibration control device operable to generate a vibration operation signal;

a work tool control device operable to generate a command signal to change the position of the work tool;

a controller electronically coupled with the vibration control device, the work tool control device, and the first and second actuators and operable to, in response to receiving the vibration operation signal and the command signal, output a signal to operate first actuator in an non-vibratory mode to change the position of the work tool while outputting a signal to operate the second actuator in a vibratory mode to cause vibration of the work tool.

12. The apparatus of claim 11, wherein the controller is operable to, in response to receiving the command signal, at least temporarily prevent operation of the first actuator in a vibratory mode.

13. The apparatus of claim 12, wherein the controller is operable to, in response to receiving the command signal, prevent operation of the first actuator in a vibratory mode while outputting the signal to operate the first actuator to change the position of the work tool.

14. The apparatus of claim 11, wherein:

the work tool control device is operable to generate a second command signal to change the position of the work tool; and the controller is operable to, in response to receiving the second command signal and the vibration operation signal, output a signal to operate the second actuator in a non-vibratory mode to change the position of the work tool and output a signal to operate the first actuator in a vibratory mode to cause vibration of the work tool.

15. The apparatus of claim 14, wherein the controller is operable to, in response to receiving the second command signal, at least temporarily prevent operation of the second actuator in a vibratory mode.

16. The apparatus of claim 15, wherein the controller is operable to, in response to receiving the second command signal, prevent operation of the second actuator in a vibratory mode while outputting the signal to operate the second actuator to change the position of the work tool.

17. The apparatus of claim 11, wherein:

the first actuator includes a first actuation member operable to move along a first axis to change the position of the work tool; and the second actuator includes a second actuation member operable to move along a second axis to change the position of the work tool.

18. The apparatus of claim 17, wherein:

the first actuator is configured and arranged such that movement of the first actuation member along the first axis changes the elevation of the work tool; and the second actuator is configured and arranged such that movement of the second actuation member along the second axis changes the tilt angle of the work tool.

* * * * *